US006428343B1

(12) United States Patent
Landis et al.

(10) Patent No.: US 6,428,343 B1
(45) Date of Patent: Aug. 6, 2002

(54) ELECTRICAL CONNECTOR FOR POWER CONDUCTORS

(75) Inventors: John M. Landis, Camp Hill; William G. Lenker, Marysville, both of PA (US)

(73) Assignee: Tyco Electronics Corporation, Middletown, PA (US)

( * ) Notice: Subject to any disclaimer, the term of this patent is extended or adjusted under 35 U.S.C. 154(b) by 0 days.

(21) Appl. No.: 09/811,308

(22) Filed: Mar. 16, 2001

(51) Int. Cl.[7] ..... H01R 4/24
(52) U.S. Cl. ..... 439/441; 439/440; 439/79
(58) Field of Search ..... 439/440, 79, 441, 439/436, 437, 83

(56) References Cited

U.S. PATENT DOCUMENTS 4,566,748 A * 1/1986 Tanishi et al. ..... 439/441
4,726,777 A 2/1988 Billman et al. ..... 439/70
4,729,740 A 3/1988 Crowe et al. ..... 439/76
5,013,253 A 5/1991 Aiello et al. ..... 439/235
5,720,546 A 2/1998 Correll, Jr. et al. ..... 362/221

* cited by examiner

*Primary Examiner*—Tho D. Ta

(57) ABSTRACT

An electrical connector is disclosed for the electrical connection between insulated power conductors and a printed circuit board. The electrical connector is defined by an insulated housing having a plurality of side-by-side cavities to receive the electrical contacts. The electrical contacts are of the wire-trap style, where a wire is trapped between a portion of the terminal and a resilient tongue, which is reversely bent beneath a contact portion. The electrical contacts further include printed circuit board contacts extending downwardly and through the housing. The electrical contacts are designed and are loaded within the cavities in such a manner that electrical arcing between adjacent contacts is eliminated.

16 Claims, 6 Drawing Sheets

2
4
6
12
18
32
34
34
34
36
40
42
44
44

24
20
6
26
22
30
6

62

6
60
64
60
58
54
52
56
50

ELECTRICAL CONNECTOR FOR POWER CONDUCTORS

BACKGROUND OF THE INVENTION

The invention relates to an electrical connector particularly for use with a power connection, and preferably for electrical interconnections between insulated power conductors and a printed circuit board.

DISCUSSION OF THE PRIOR ART

It is common in the electrical power industry to have so-called screwless wire connectors such that a wire can be inserted into an electrical connector where a binding screw is not required. A binding screw is the type of interconnection on electrical receptacles and the like, where a wire is wrapped around a screw and the binding screw is tightened until the wire is pressed against its corresponding connection plate. Another type of interconnection is a wire-trap style connection where a wire is trapped on the connector. This type of electrical connection requires that the end of the insulation of an insulated wire is stripped, usually to a predetermined length, but the conductor is not bent to be placed under a binding screw. Rather, the wire is placed into a wire receiving opening in a connector housing, and an electrical terminal has a resiliently bent tongue, which, upon pressing the wire into position, traps the wire in place in electrical connection with the resilient tongue. Pulling on the wire or strain on the wire causes only a further tightening of the connection and thus it is common to have a slot adjacent to the resiliently bent tongue to insert a tool to release the wire.

It is also known to incorporate such an electrical connector on a printed circuit board for a power connection. See, for example, U.S. Pat. No. 4,729,740, which illustrates an electrical connector having a housing which can be right-angle mounted on a printed circuit board, where the connector includes wire receiving openings to receive stripped conductors and a wire-trap style electrical terminal to receive the stripped conductor in binding relation upon insertion.

While the connector as depicted in the above-mentioned patent is usable for the particular application as shown, other similar connectors used in different applications have resulted in arcing between the electrical terminals, particularly between the terminals connecting to the printed circuit board, due to the spacing between the electrical terminals. As mentioned above, such terminals are used for power connections, for example, with a ballast-type fluorescent fixture connection, and if terminals are spaced too close to each other, the air gap between them allows for arcing between the terminals, which in turn can result in premature failure of the ballast.

The object of the invention, then, is to provide an electrical connector for use with power conductors, and which is for particular use with printed circuit board connections, which improves upon and eliminates the shortcomings of prior art style connectors.

SUMMARY OF THE INVENTION

The objects of the invention have been accomplished by providing a power connector for the electrical connection of a plurality of wires to a printed circuit board, where the connector comprises an insulating housing and a plurality of electrical contacts. The housing includes a wire receiving face and a board mounting face opposed to the wire receiving face, the wire receiving face having a plurality of wire openings for receiving stripped electrical wires, the openings positioned in a staggered array with the openings alternately disposed on opposite sides of a longitudinal centerline. The electrical contacts have a wire contact portion, and a circuit board contact portion extending from the board mounting face, thereby forming a staggered array of circuit board contact portions alternately disposed on opposite sides of the longitudinal centerline, such that each circuit board contact portion is positioned on a side of the longitudinal centerline opposed to the opening corresponding to the circuit board contact portion.

In the preferred version of the power connector, the housing is comprised of a plurality of side-by-side contact receiving cavities, where the cavities open from the board mounting face. Also preferably, the wire openings extend through the wire receiving face and the contact receiving cavities extend between the longitudinal side walls.

The plurality of electrical contacts comprise first and second contacts, where the wire contact portion of the first contact comprises a first base portion and two upstanding arms, where the first base portion is angled upwardly and projects toward the second longitudinal wall. The wire contact portion of the second contact comprises a second base portion and two upstanding arms, the second base portion being angled upwardly and projecting towards the first longitudinal wall. Preferably, the wire contact portion of the first and second contacts are comprised of blade contact portions extending upwardly from one of the two upstanding arms, the blade contact portions being reversely bent below the other of the two upstanding arms. Also preferably, the wire openings in the housing are aligned with an intersection of the blade contact portions, and the other of the two upstanding arms.

In another embodiment of the invention, a power connector for the electrical connection of a plurality of wires to a printed circuit board is provided where an insulating housing has a wire receiving face including a plurality of wire openings for receiving stripped electrical wires, and the housing has a plurality of side-by-side cavities. A plurality of electrical contacts are positioned in the cavities, the contacts having wire contact portions positioned adjacent to the wire openings for connection to the wire and circuit board contact portions extending downwardly from the housing. The circuit board contact portions are disposed in a staggered array on opposite sides of a longitudinal centerline, where the electrical contacts are profiled such that the wire contact portions within the cavities, which are proximate a circuit board contact portion in an adjacent cavity, are elevated within the cavity to increase the spacing between the adjacent circuit board contact portions.

In this embodiment of the connector, it is preferable that the insulating housing has first and second longitudinal side walls and end walls, with at least two contacts positioned in the side-by-side cavities. The wire contact portion of a first contact comprises a first base portion and two upstanding arms, the first base portion being angled upwardly and projecting towards the second longitudinal wall, and the wire contact portion of a second contact comprises a second base portion and two upstanding arms, the second base portion being angled upwardly and projecting towards the first longitudinal wall. The wire contact portion of the first and second contacts are comprised of blade contact portions extending upwardly from one of the two upstanding arms, the blade contact portions being reversely bent below the other of the two upstanding arms. The wire openings in the housing are aligned with an intersection of the blade contact portion, and the other of the two upstanding arms.

In yet another embodiment of the invention, a power connector for the electrical connection of a plurality of wires to a printed circuit board comprises an insulating housing having a wire receiving face including a plurality of wire receiving openings, first and second longitudinal side walls and end walls, and a plurality of side-by-side cavities. A plurality of electrical contacts are positioned in the cavities, where a first contact has a wire contact portion positioned in a cavity and a circuit board contact portion extending downwardly from the housing adjacent the first longitudinal wall, and a second contact has a wire contact portion disposed in the adjacent cavity, with a circuit board contact portion extending downwardly from the housing and adjacent the second longitudinal wall. The wire contact portion of the first contact comprises a first base portion and two upstanding arms, the first base portion being angled upwardly and projecting towards the second longitudinal wall, and the wire contact portion of the second contact comprising a second base portion and two upstanding arms, the second base portion being angled upwardly and projecting towards the first longitudinal wall.

In this embodiment, it is preferable that the housing be comprised of a plurality of side-by-side contact receiving cavities, where the cavities open from a bottom of the housing. The housing is comprised of a top wall, longitudinal side walls, and end walls and the wire openings extend through the top wall. The contact receiving cavities extend between the longitudinal side walls. The wire contact portion of the first and second contacts are comprised of blade contact portions extending upwardly from one of the two upstanding arms, the blade contact portions being reversely bent below the other of the two upstanding arms. The wire openings in the housing are aligned with an intersection of the blade contact portion, and the other of the two upstanding arms.

BRIEF DESCRIPTION OF DRAWINGS

The invention will now be described by way of reference to the drawing figures where.

DETAILED DESCRIPTION OF THE PREFERRED EMBODIMENT

Figure 1:
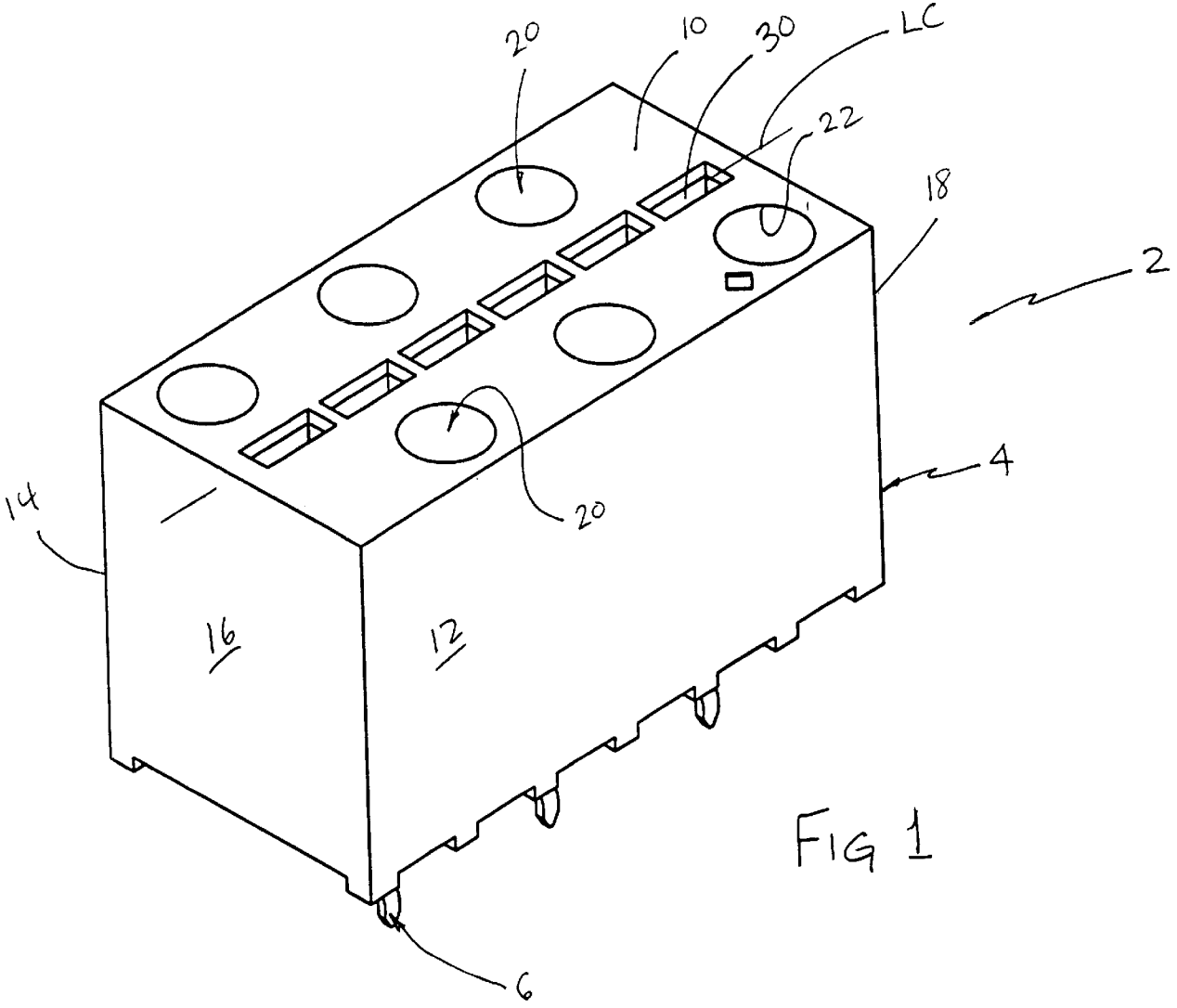
FIG. 1 is a perspective view of the electrical power connector of the subject invention.
Figure 2:
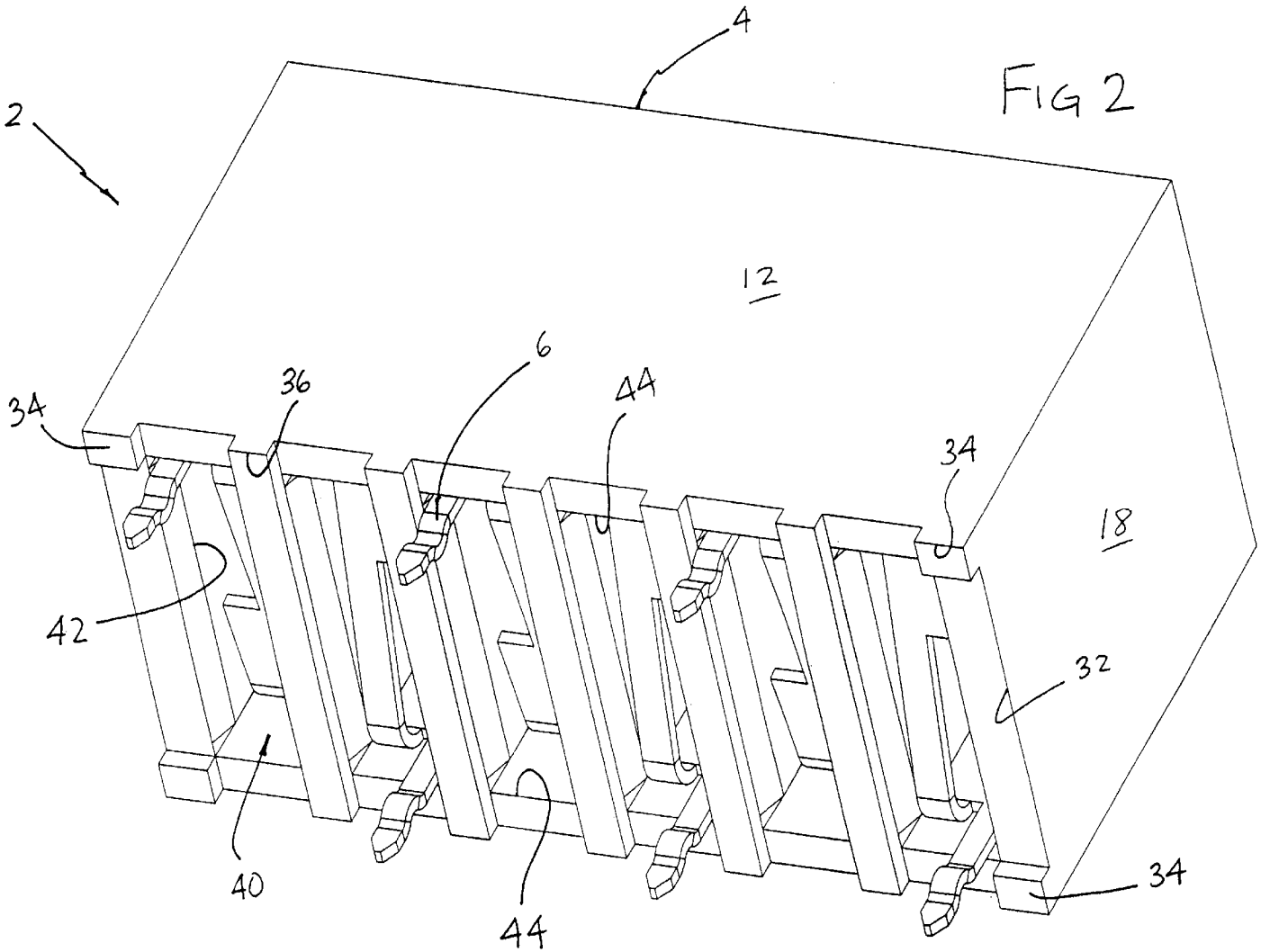
FIG. 2 is a perspective view from the lower side of the electrical connector of FIG. 1.

With reference first to FIGS. 1 and 2, an electrical connector is shown generally at 2, which includes an insulating housing 4 comprised of a material such as a plastic material, and a plurality of electrical contacts shown generally at 6. As will be described herein, the electrical connector shown in FIGS. 1 and 2 is profiled for both receiving a plurality of stripped electrical power conductors, as well as for placement and connection to a printed circuit board.

Figure 4:
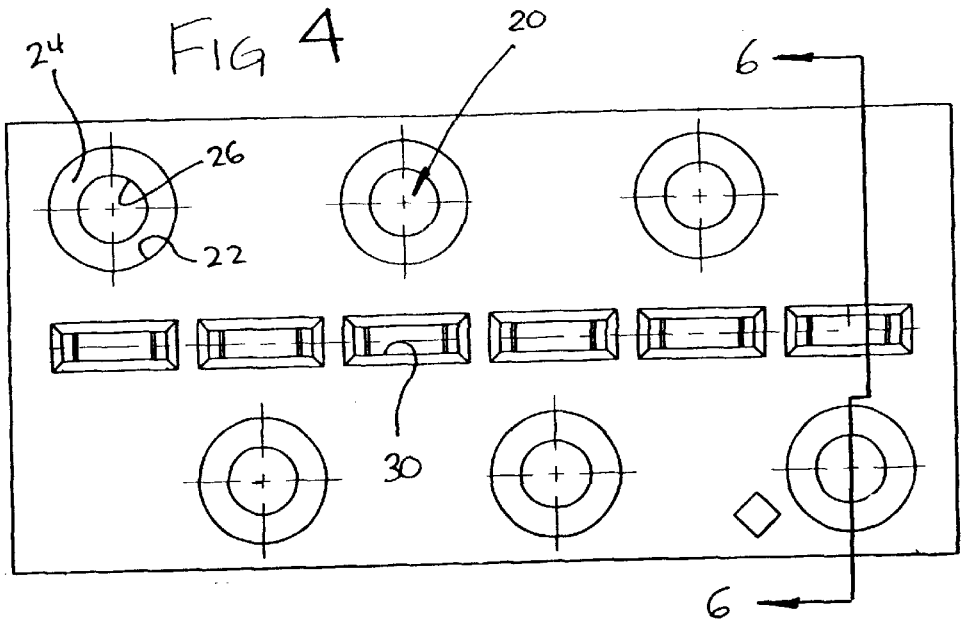
FIG. 4 is a top plan view of the electrical connector of FIGS. 1 or 2.
Figure 6:
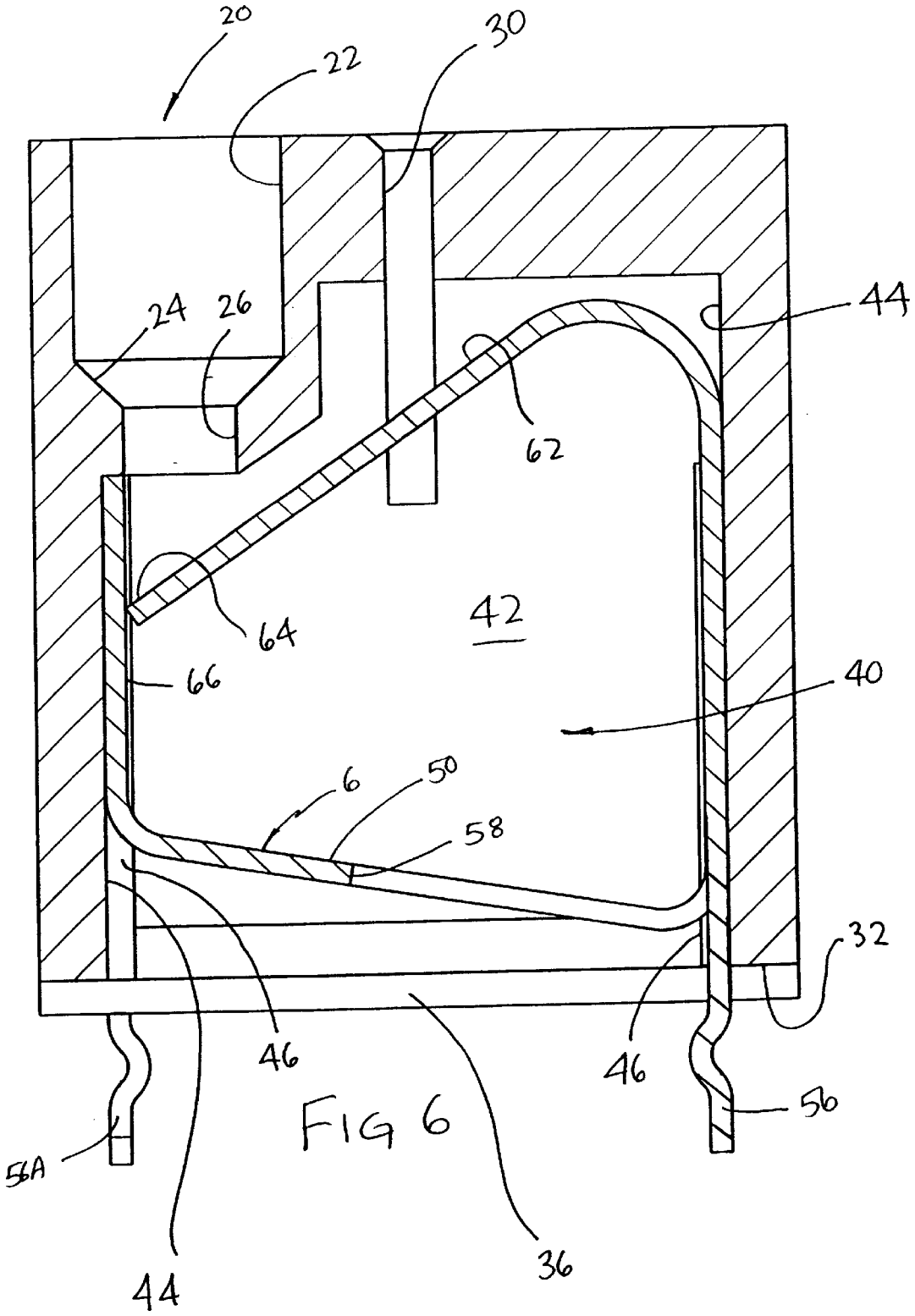
FIG. 6 is a cross sectional view through the staggered lines 6—6 of FIG. 4.

With reference still to FIGS. 1 and 2, the insulating housing 4 will be described in greater detail. As shown in FIG. 1, the insulating housing 4 is generally comprised of a top wire receiving face 10, longitudinal side walls 12 and 14, and end walls 16 and 18. The top wire connecting face 10 includes a plurality of wire receiving openings 20 which include a first bore section 22, a stop surface 24 (FIG. 4), and a second bore section 26, having a smaller diameter than that of bore section 22. It should be noted that the wire receiving openings 20, are somewhat staggered, such that they alternate to opposite sides of a longitudinal centerline (LC), as shown best in FIG. 4. As also shown in FIGS. 1 and 6, a tool insertion slot 30 is shown which will be described herein in further detail. With reference now to FIG. 2, the housing 4 further includes a board mounting face 32 opposed to the wire receiving face 10 having corner standoffs at 34 and a plurality of standoff ribs at 36.

Figure 3:
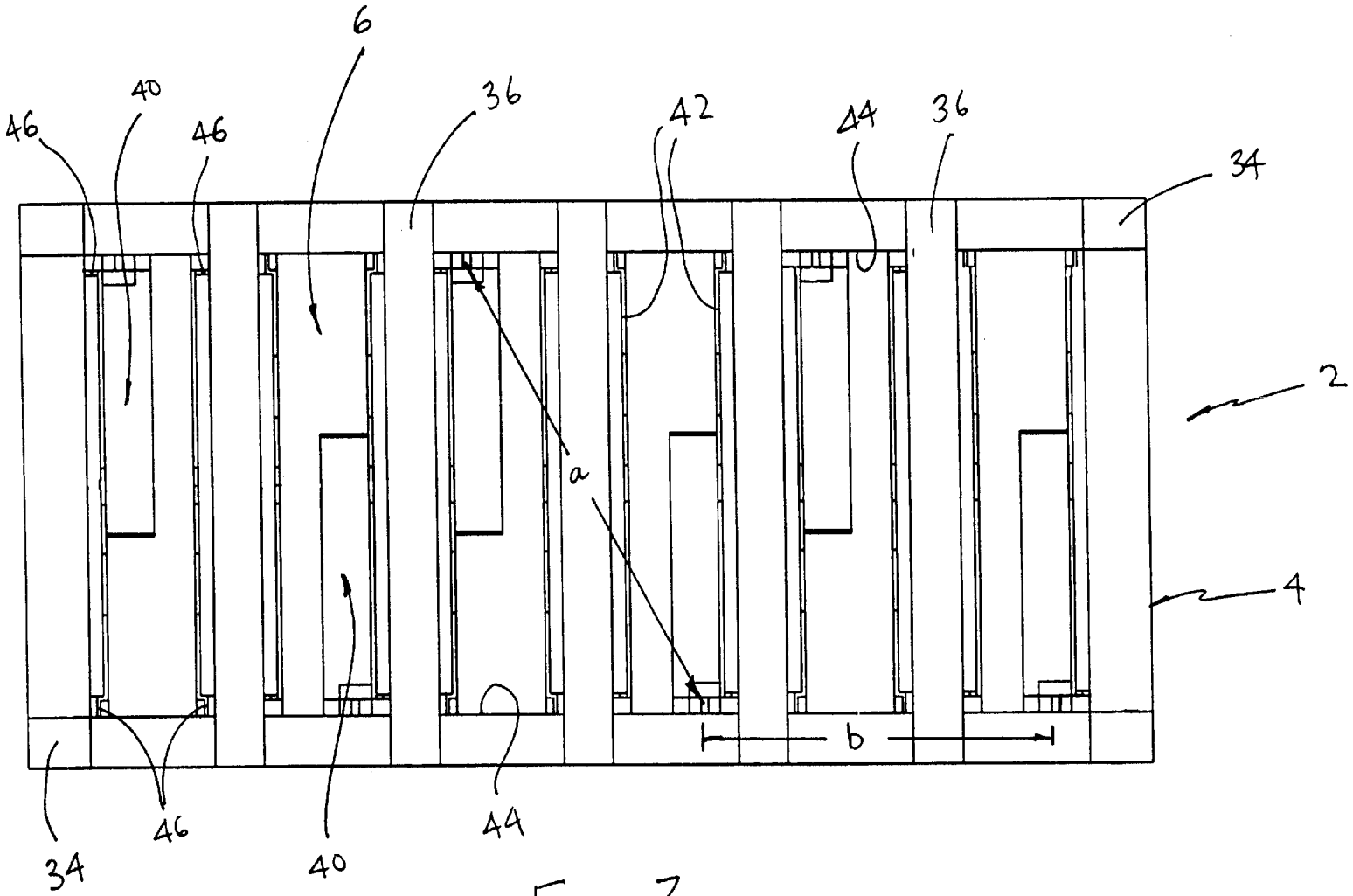
FIG. 3 is a lower plan view of the electrical connector of FIG. 2.
Figure 5:
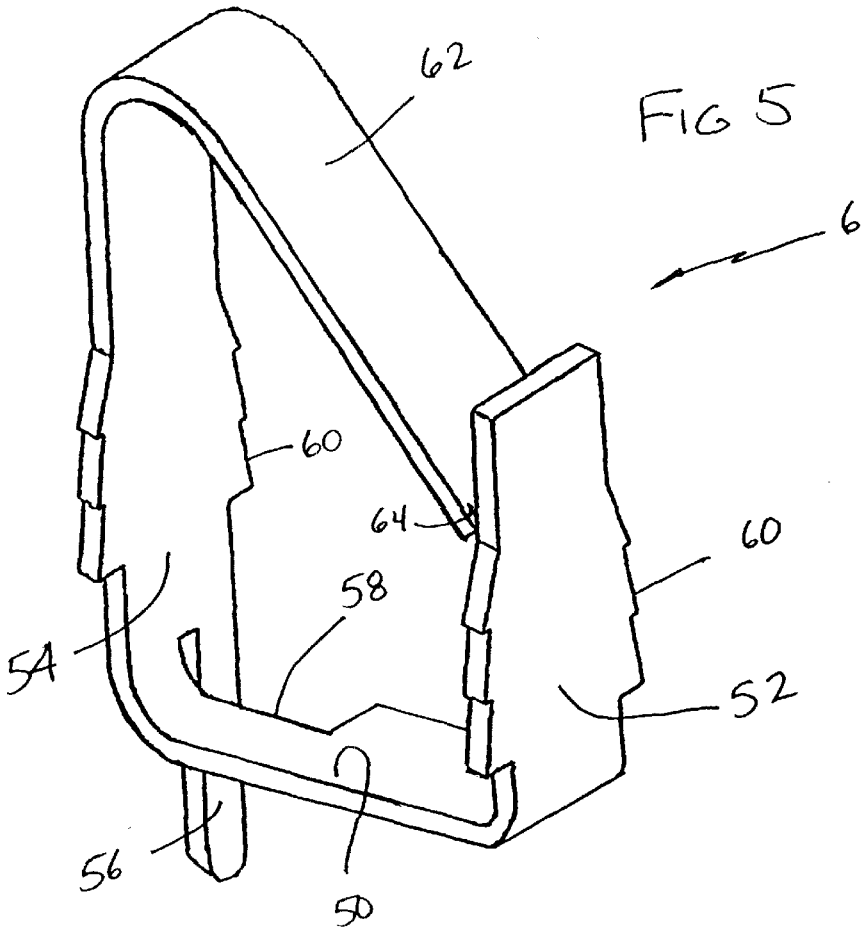
FIG. 5 is a perspective view of one of the power contacts when removed from the connector of FIGS. 1 or 2.

With reference now to FIGS. 2 and 3, the housing 4 further comprises a plurality of contact receiving cavities 40 which extend upwardly from the board mounting face 32 to receive the electrical contacts 6. Each of the cavities 40 is comprised of inner side walls at 42 and end walls at 44. Each of the side walls 42 further includes end slots at 46, as best shown in FIGS. 2, 3 and 6. With respect now to FIG. 5, the electrical contact 6 is shown which is a stamped and formed metal contact including a base portion 50 having an arm portion 52 extending from one side thereof, and an arm portion 54 extending from the opposite side thereof. A printed circuit board contact 56 is stamped from the base portion 50 resulting in the cut-out portion at 58. The arm portions 52 and 54 have barbs 60 along the side edges for locking the contacts as will be described herein. The arm portion 54 extends upwardly to a position where it is reversely bent to form a tongue or blade section 62. It should be appreciated that an end 64 of reversely bent tongue 62, together with an inside surface 66 of arm 52, form contact surfaces for the wire to be trapped, as described further herein.

With respect now to FIG. 6, the assembly of the connector will be described where each contact cavity 40 is loaded with one of the terminals 6, such that the arms 52, 54 are inserted into slots 46. It should also be appreciated that the slots are of a width where the barbs will interfere along side edges thereof so as to be fixed therein. It should also be appreciated that the contacts are loaded in an alternating manner, such that every other contact has the printed circuit board contact 56 along a different longitudinal side wall. As shown in FIG. 6, and as the contact 6 is loaded, the wire receiving openings 20 are positioned directly above end 64 of the contact 6, and slot 30 provides access into the cavity 40 and to the top of blade portion 62.

With respect still to FIG. 6, to use the electrical connector as described above, an electrical power conductor would be stripped of the insulation at its end, to expose the internal copper wire conductor, and the stripped portion would be inserted through the wire receiving opening 20. The stripped conductor of the wire would be inserted through the cylindrical bore portion 26, yet the end of the insulation would abut section 24 leaving the insulation within cylindrical bore portion 22. The insertion of the stripped end of the conductor forces the tongue 62 downwardly (in the counter-clockwise sense as viewed in FIG. 6) such that the conductor now resides between end 64 and contact surface 66. This forms a wire-trap type terminal, where pulling on the wire causes further locking engagement between the wire and the terminal. Rather to remove the wire from the connector, a tool such as a blade is inserted into the slot 60 to bias the tongue 62 downwardly to release the wire.

Advantageously then, the connector as described above provides a design of electrical connector which can be both mounted to printed circuit boards, and utilized with power wires. This use is enhanced by providing an alternating arrangement of the printed circuit board contacts on opposite sides of the longitudinal centerline. This places some distance between adjacent printed circuit board contacts. For example, with respect to FIG. 3, the distance between adjacent printed circuit board contacts in adjacent cavities is a distance A, which is a diagonal distance. Whereas the distance between adjacent printed circuit board contacts on the same side of the longitudinal centerline is a distance B. Both distances A and B are substantially greater than the distance between adjacent contacts, had they been on the same side of the longitudinal centerline. Moreover, and with respect to FIG. 6, due to the fact that the base portion 50 of the terminal 6 is elevated as it moves away from the printed circuit board contact 56, this positions the portion of the electrical contact 6 at a greater distance from the next adjacent printed circuit board contact 56A (see FIGS. 2 and 6).

Figure 7:
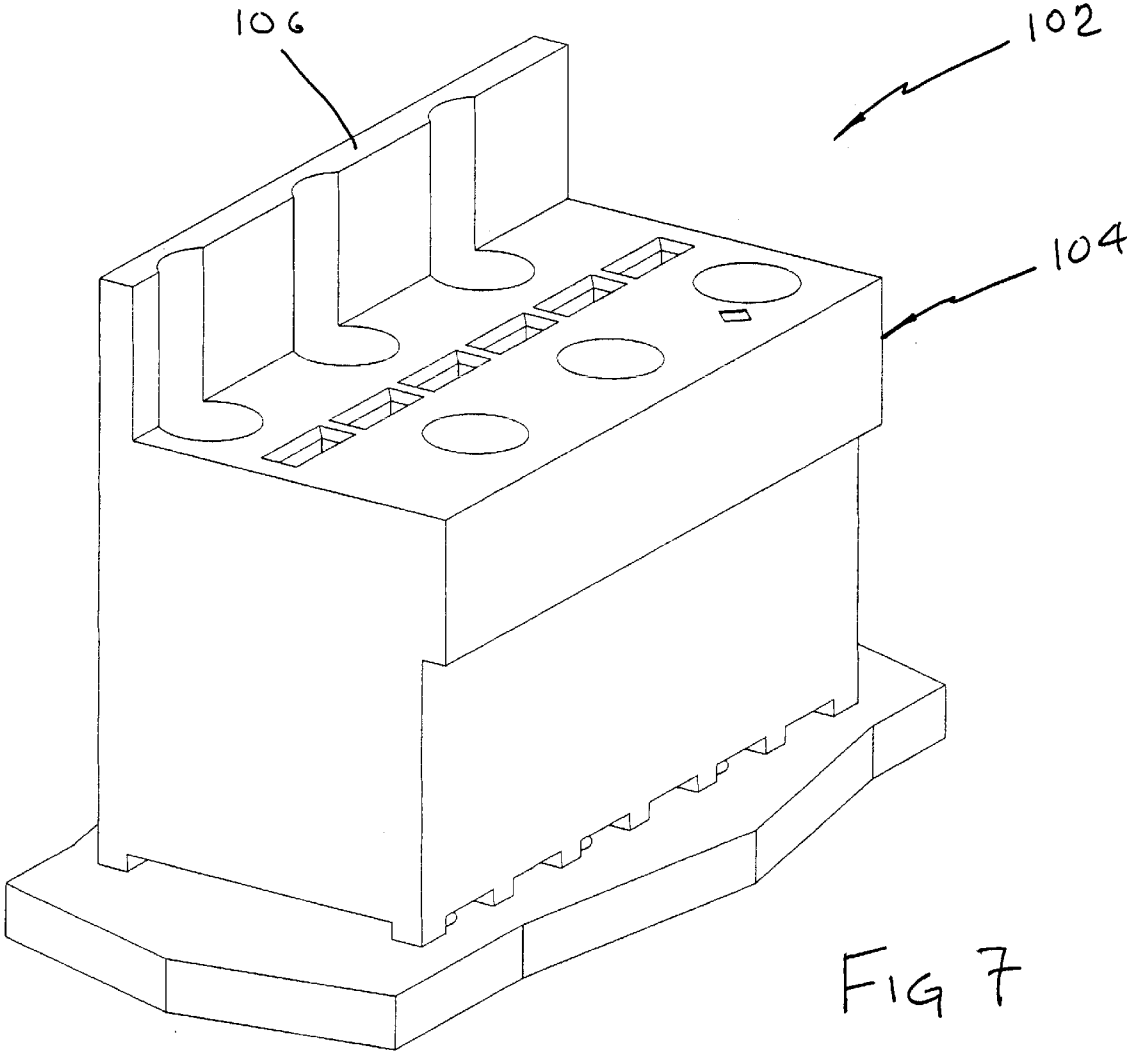
FIG. 7 is an alternate embodiment for use near adjacent metal enclosures.

With reference now to FIG. 7, an alternate embodiment of the invention is shown as connector 102 having a housing 104. The housing 104 includes a barrier wall 106 upstanding from the housing which prevents arcing, in the event the connector needs to be placed adjacent to a metal enclosure, such as a ballast.

What we claim is:

1. A power connector for the electrical connection of a plurality of wires to a printed circuit board, the connector comprising:

an insulating housing including a wire receiving face and a board mounting face opposed to the wire receiving face, the wire receiving face having a plurality of wire openings for receiving stripped electrical wires, the openings positioned in a staggered array with said openings alternately disposed on opposite sides of a longitudinal centerline, and a plurality of electrical contacts each of the plurality of contacts including a wire contact portion and a circuit board contact portion, the circuit board contact portion extending from the board mounting face thereby forming a staggered array of circuit board contact portions alternately disposed on opposite sides of said longitudinal centerline such that each circuit board contact portion is positioned on a side of the longitudinal centerline opposed to the opening corresponding to the circuit board contact portion.

2. The power connector of claim 1, wherein said housing is comprised of a plurality of side-by-side contact receiving cavities, where said cavities are configured to receive the electrical contacts from the board mounting face.

3. The power connector of claim 2, wherein contact receiving cavities extend between opposed longitudinal side walls.

4. A power connector as recited in claim 1, wherein the wire contact portion of each of said plurality of electrical contacts comprises a first and a second arm and a base portion coupling the first and second arms, the base portion and the first arm forming an acute angle and wherein the plurality of contacts are housed within the housing such that the first arm of a first set of the plurality of contacts abuts an interior surface of a first longitudinal side wall of the housing and the second arm of the first set abuts an interior surface of a second longitudinal side wall of the housing opposed to the first longitudinal side wall and the first arm of a second set of the plurality of contacts abuts the interior surface of the second longitudinal side wall and the second arm of the second set abuts the interior surface of the first longitudinal side wall and every contact of the first set is positioned adjacent to a contact of the second set.

5. The power connector of claim 4, wherein said wire contact portion further comprises a blade contact portion extending upwardly from one of said two upstanding arms, said blade contact portion being reversely bent below the other of said two upstanding arms.

6. The power connector of claim 5, wherein said wire openings in said housing are aligned with an intersection of said blade contact portions and the other of said two upstanding arms.

7. A electrical connector comprising:

an insulating housing having a wire receiving face, a board mounting face opposed to the wire receiving face, and a plurality of side-by-side cavities; and a plurality of electrical contacts positioned in said cavities, each said contact having (1) a wire contact portion including a first and a second arm and a base portion coupling the first and second arms, wherein an intersection of the first arm and the base portion is a lesser distance from the board mounting face than an intersection of the second arm and the base portion and (2) a circuit board contact portion extending from said first arm and beyond said board mounting face, the plurality of contacts arranged such that said circuit board contact portions are disposed in a staggered array on opposite sides of a longitudinal centerline.

8. A power connector as recited in claim 7, wherein the base portion and the first arm forming an acute angle and wherein the plurality of contacts are housed within the housing such that the first arm of a first set of the plurality of contacts abuts an interior surface of a first longitudinal side wall of the housing and the second arm of the first set abuts an interior surface of a second longitudinal side wall of the housing opposed to the first longitudinal side wall and the first arm of a second set of the plurality of contacts abuts the interior surface of the second longitudinal side wall and the second arm of the second set abuts the interior surface of the first longitudinal side wall and every contact of the first set is positioned adjacent to a contact of the second set.

9. The power connector of claim 8, wherein said wire contact portion of said first and second contacts are comprised of blade contact portions extending upwardly from one of said two upstanding arms, said blade contact portions being reversely bent below the other of said two upstanding arms.

10. The power connector of claim 11, wherein said wire openings extend through said wire receiving face.

11. A power connector for the electrical connection of a plurality of wires to a printed circuit board, the connector comprising:

an insulating housing having a wire receiving face including a plurality of wire receiving openings, a board mounting face opposed to the wire receiving face, first and second longitudinal side walls and end walls, and a plurality of side-by-side cavities; and a plurality of electrical contacts positioned in said cavities comprising a wire contact portion positioned in a cavity and a circuit board contact portion extending from said board mounting face, said wire contact portion comprising a base portion and two upstanding arms, said base portion forming an acute angle with one of the upstanding arms wherein adjacent contacts are rotated 180 degrees, relative to each other, about an axis perpendicular to a longitudinal axis of the housing.

12. The power connector of claim 11, wherein said plurality of side-by-side cavities are configured to receive the contacts from the board mounting face.

13. The power connector of claim 12, wherein said wire openings in said housing are aligned with an intersection of said blade contact portion, and the other of said two upstanding arms.

14. The power connector of claim 11, wherein contact receiving cavities extend between said longitudinal side walls.

15. The power connector of claim 11, wherein said wire contact portion further comprises a blade contact portion extending upwardly from one of said two upstanding arms, said blade contact portion being reversely bent below the other of said two upstanding arms.

16. The power connector of claim 15, wherein the wire openings in said housing are aligned with an intersection of said blade contact portion, and the other of said two upstanding arms.

* * * * *